US006600449B2

(12) United States Patent
Onaka et al.

(10) Patent No.: US 6,600,449 B2
(45) Date of Patent: Jul. 29, 2003

(54) ANTENNA APPARATUS

(75) Inventors: Kengo Onaka, Yokohama (JP); Shoji Nagumo, Kawasaki (JP); Takashi Ishihara, Machida (JP); Jin Sato, Sagamihara (JP); Akira Miyata, Yokohama (JP); Kazunari Kawahata, Machida (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 10/090,158

(22) Filed: Mar. 5, 2002

(65) Prior Publication Data

US 2002/0145569 A1 Oct. 10, 2002

(30) Foreign Application Priority Data

Apr. 10, 2001 (JP) ..... 2001-111482

(51) Int. Cl.[7] ..... H01Q 1/36

(52) U.S. Cl. ..... 343/700 MS; 343/815; 343/702

(58) Field of Search ..... 343/700 MS, 702, 343/815, 818, 846, 848, 850

(56) References Cited

U.S. PATENT DOCUMENTS

| | | | | | |
|---|---|---|---|---|---|
| 5,696,517 | A | * | 12/1997 | Kawahata et al. | 343/700 MS |
| 5,861,854 | A | * | 1/1999 | Kawahata et al. | 343/702 |
| 6,201,502 | B1 | * | 3/2001 | Kurita et al. | 343/702 |
| 6,281,848 | B1 | * | 8/2001 | Nagumo et al. | 343/700 MS |
| 6,300,909 | B1 | * | 10/2001 | Tsubaki et al. | 343/700 MS |
| 6,323,811 | B1 | * | 11/2001 | Tsubaki et al. | 343/700 MS |
| 6,333,716 | B1 | | 12/2001 | Pontoppidan | |
| 6,433,746 | B2 | * | 8/2002 | Kushihi et al. | 343/700 MS |

* cited by examiner

*Primary Examiner*—Tan Ho
(74) *Attorney, Agent, or Firm*—Keating & Bennett, LLP

(57) ABSTRACT

An antenna apparatus includes a dielectric base, and a plurality of feeding-radiating elements having different resonance frequencies, each including a feeding electrode and a radiating electrode which are disposed on surfaces of the base. A stub with a common feeding point is disposed on a mounting substrate which supports the base. The feeding electrodes of the feeding-radiating elements are connected to matching points of the stub, thereby achieving impedance matching for each of the feeding-radiating elements.

20 Claims, 4 Drawing Sheets

ANTENNA APPARATUS

BACKGROUND OF THE INVENTION

1. Field of the Invention

The present invention generally relates to an antenna apparatus, and more particularly, to an antenna apparatus having a plurality of feeding-radiating elements.

2. Description of the Related Art

In recent years, the number of cellular telephones using a plurality of frequency bands has increased. Such cellular telephones switch from one frequency band in which telephone traffic concentration occurs to another frequency band to achieve smooth telephone communication. The cellular telephones of this type require an antenna which is excited in two frequency bands. For example, U.S. Pat. No. 6,333,716 discloses an antenna for use in GSM (Global System for Mobile Communications) cellular telephones which is excited at frequencies in the 900 MHz and 1800 MHz bands.

This type of antenna includes a metallic pattern disposed on a dielectric housing, and a slit formed in the metallic pattern to form two feeding-radiating elements having different electrical lengths, wherein a signal current fed from a common feeding point causes one of the feeding-radiating elements to be excited at a frequency in the 900 MHz band and causes the other feeding-radiating element to be excited at a frequency in the 1800 MHz band.

However, typically, when a current is fed from a common feeding point to a plurality of feeding-radiating elements, in a frequency band allocated to each of the feeding-radiating elements, sufficient radiating resistance may not be maintained for each feeding-radiating element because each of the feeding-radiating elements does not experience the optimum electrical length from the feeding point to the feeding-radiating element, thereby making the bandwidth for resonance narrower. Another problem arises in that insufficient signal power supply resulting from no impedance matching between each of the feeding-radiating elements and the signal source causes insufficient gain of the feeding-radiating elements, or causes variations in gain from one feeding-radiating element to another.

SUMMARY OF THE INVENTION

In order to overcome the problems described above, preferred embodiments of the present invention provide an antenna apparatus having a plurality of feeding-radiating elements, wherein excellent electrical matching is achieved for each of the feeding-radiating elements.

According to a preferred embodiment of the present invention, an antenna apparatus includes a dielectric base, a plurality of feeding-radiating elements each including a feeding electrode and a radiating electrode which are disposed on surfaces of the base, and a substrate which fixedly supports the base, wherein a common feeding point for feeding a current to the plurality of feeding-radiating elements is disposed on the substrate, a stub continuously expanding from the feeding point is disposed on a surface of the substrate, or on a surface of the base and a surface of the substrate, and the feeding electrodes of the plurality of feeding-radiating elements are connected to matching points of the stub which are determined based on the effective line length of the radiating electrodes.

The feeding-radiating elements are excited at the resonance frequency which depends upon the effective line length of the radiating electrodes. Since the feeding electrode of each of the feeding-radiating elements is connected to the matching point of the stub which has the optimum stub length for each feeding-radiating element, each feeding-radiating element can achieve an excellent resonance property at the resonance frequency, while the required bandwidth can be maintained in the frequency band to which the resonance frequency belongs.

The stub length optimization for each of the feeding-radiating elements allows the optimum impedance matching between the feeding-radiating elements and the feeding point or the signal source, thereby allowing the maximum power to be supplied from the signal source to the feeding-radiating elements to increase the gain of the feeding-radiating elements. The effective line length L of a radiating electrode is expressed by $L=\lambda/4\sqrt{\in}$, where $\in$ denotes the effective relative dielectric constant of a base, and $\lambda$ denotes the wavelength of resonance frequency. As used herein, "a surface of a base" indicates at least one surface of a three-dimensionally shaped base. The stub may be a short stub or an open stub, and is disposed on a surface of a substrate, or on a surface of the substrate and a surface of a base.

Preferably, a radiating electrode without a feeding electrode is arranged on a surface of the base so as to be adjacent to the radiating electrode of at least one of the plurality of feeding-radiating elements.

The radiating electrode without a feeding electrode defines a parasitic radiating element. The parasitic radiating element is electromagnetically coupled with a feeding-radiating element adjacent thereto, and is thus energized to resonate at a frequency in the same frequency band as that of the resonance frequency of the adjacent feeding-radiating element. Accordingly, dual resonance matching can be achieved between the resonance frequency of the feeding-radiating element and the resonance frequency of the parasitic radiating element, and the frequency bandwidth for the dual resonance can thus be broader than the frequency bandwidth for the resonance by the feeding-radiating element alone.

The stub may be a short stub of which a portion far from the feeding point is coupled to the ground.

Therefore, the optimum reactance which is expressed by the stub length using the ground potential as a reference for each of the feeding-radiating elements can be applied to the feeding-radiating elements. Then, the optimum resonance matching can be achieved for each of the feeding-radiating elements. For example, a longer stub length may be set for a feeding-radiating element having a lower resonance frequency, while a shorter sub length may be set for a feeding-radiating element having a higher resonance frequency, thereby achieving the optimum impedance matching between each of the feeding-radiating elements and the feeding point.

The antenna apparatus further includes a ground conductive layer provided on the substrate. The stub may be an open stub which is separated from the ground conductive layer by a slit formed in the ground conductive layer.

The reactance to be applied to each of the feeding-radiating elements is provided based on a distance from a feeding point of the open stub to the feeding electrode of each of the feeding-radiating elements. Therefore, the feeding-radiating elements can have an electrical length which achieves resonance property optimization at a prescribed frequency band.

A reactor may be connected between the stub and the ground conductive layer.

Since the stub is partially formed of a lumped element such as a reactor, for example, an inductor or a capacitor, the effective stub length can be changed by selecting the reactance of the lumped element. When reactance is applied to an open stub, the stub will be a short stub.

The reactor may include a pattern electrode having a reactance component which is disposed on a surface of the base.

As a result, the stub length can be changed without using a lumped element. The reactance of the pattern electrode can be changed by changing the length, width, or configuration of the pattern electrode. The pattern electrode can be provided on a surface of the base together with a feeding electrode, and the pattern formation can thus be readily performed.

The stub may include a feeding land having a feeding point provided on the substrate, and a stub pattern which is disposed on a surface of the base and which is connected to the feeding land.

The feeding electrode of each of the feeding-radiating elements may be integrally connected beforehand at the position of a matching point of the stub pattern on the base. When one end of the stub pattern is connected to the feeding land, final matching between each of the feeding-radiating elements and the feeding point or supply source is achieved. The stub pattern may be a short stub by coupling to the ground the end of the stub pattern opposite to the end which is connected to the feeding land. Alternatively, the stub pattern may be an open stub by making the opposing end open. The optimum stub length from the matching point to the feeding electrode of each of the feeding-radiating elements can be changed by changing the length and width of the stub pattern.

Other features, elements, characteristics and advantages of the present invention will become more apparent from the following detailed description of preferred embodiments thereof with reference to the attached drawings.

DETAILED DESCRIPTION OF PREFERRED EMBODIMENTS

Figure 1:
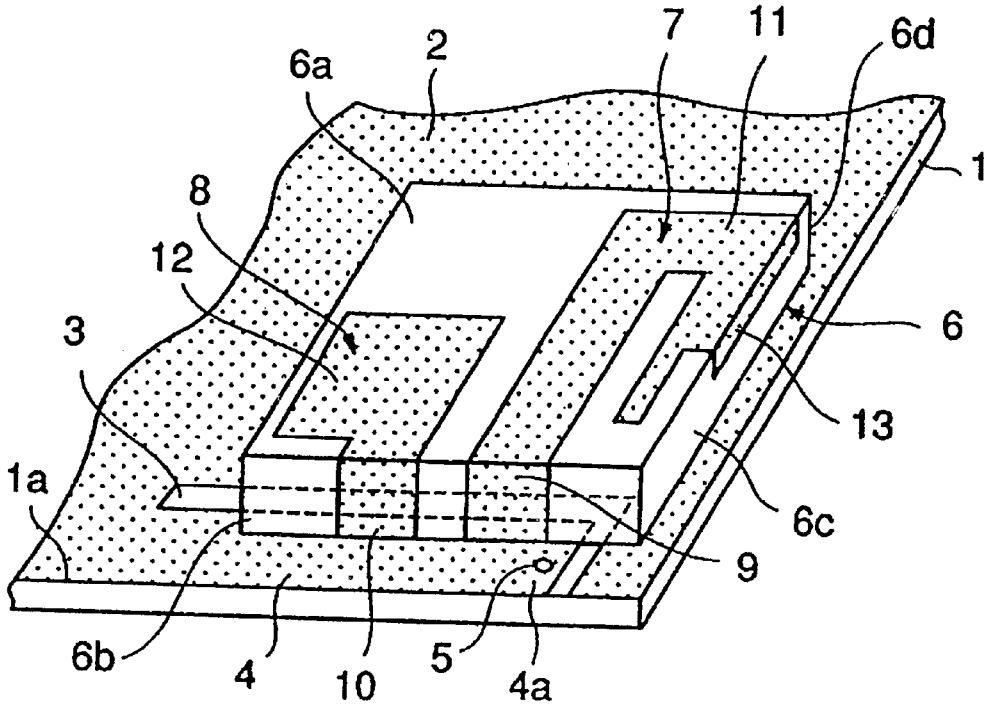
FIG. 1 is a perspective view of an antenna apparatus according to a first preferred embodiment of the present invention.

The present invention is hereinafter described with respect to its specific preferred embodiments, taken in conjunction with the drawings. FIG. 1 shows an antenna apparatus according to a first preferred embodiment of the present invention.

In FIG. 1, a substrate 1 is a mounting substrate made of, for example, epoxy resin containing a glass fiber. A ground conductive layer 2 which is a conductor made of copper or other suitable material is disposed on one surface of the substrate 1. A slit 3 having a substantially L-shaped configuration starting from a substrate edge 1*a* is formed in the ground conductive layer 2. Specifically, the slit 3 first extends in a direction that is substantially perpendicular to the substrate edge 1*a,* and is then bent at a right angle, extending substantially parallel to the substrate edge 1*a.* The slit 3 produces a tongue-like short stub 4 extending along the substrate edge 1*a* with an equal width. The root portion of the short stub 4 joins with the ground conductive layer 2, and a feeding point 5 connected to a signal source (not shown) is positioned on the tip 4*a* of the short stub 4.

A substantially rectangular-block base 6, which is preferably made of a dielectric material such as a ceramic material or a plastic material, has a first feeding-radiating element 7 and a second feeding-radiating element 8 disposed thereon. The first feeding-radiating element 7 includes a first strip feeding electrode 9 which extends in the vertical direction across a first side surface 6*b* of the base 6, a first radiating electrode 11 which extends straight from the top end of the first feeding electrode 9 on the principal surface 6*a* of the base 6 and which turns around near a side surface 6*d* facing the first side surface 6*b* along a second side surface 6*c,* and a capacitive electrode 13 which extends downward from the turnaround portion of the first radiating electrode 11 on the second side surface 6*c* of the base 6. The first feeding-radiating element 7 has an electrical length for excitation at a frequency of a predetermined frequency band, for example, the 900 MHz band.

The second radiating element 8 includes a second strip feeding electrode 10 which extends substantially parallel to the first feeding electrode 9 on the first side surface 6*b* of the base 6, and a second radiating electrode 12 which expands to the left from the top end of the second feeding electrode 9 on the principal surface 6*a* of the base 6. Accordingly, the second feeding-radiating element 8 has an electrical length for excitation at a higher frequency than the resonance frequency, for example, at a frequency of the 1800 MHz band.

The base 6 including the first feeding-radiating element 7 and the second feeding-radiating element 8 is fixed preferably by soldering to the ground conductive layer 2 of the substrate 1 using a fixed electrode (not shown) formed on the bottom of the base 6. The bottom end of the first feeding electrode 9 of the first feeding-radiating element 7 and the bottom end of the second feeding electrode 10 of the second feeding-radiating element 8 are soldered to different portions of the short stub 4. Therefore, a signal power is supplied from the feeding point 5 positioned on the substrate 1 to the first and second feeding electrodes 9 and 10 according to different reactance of the short stub 4.

Figure 2:
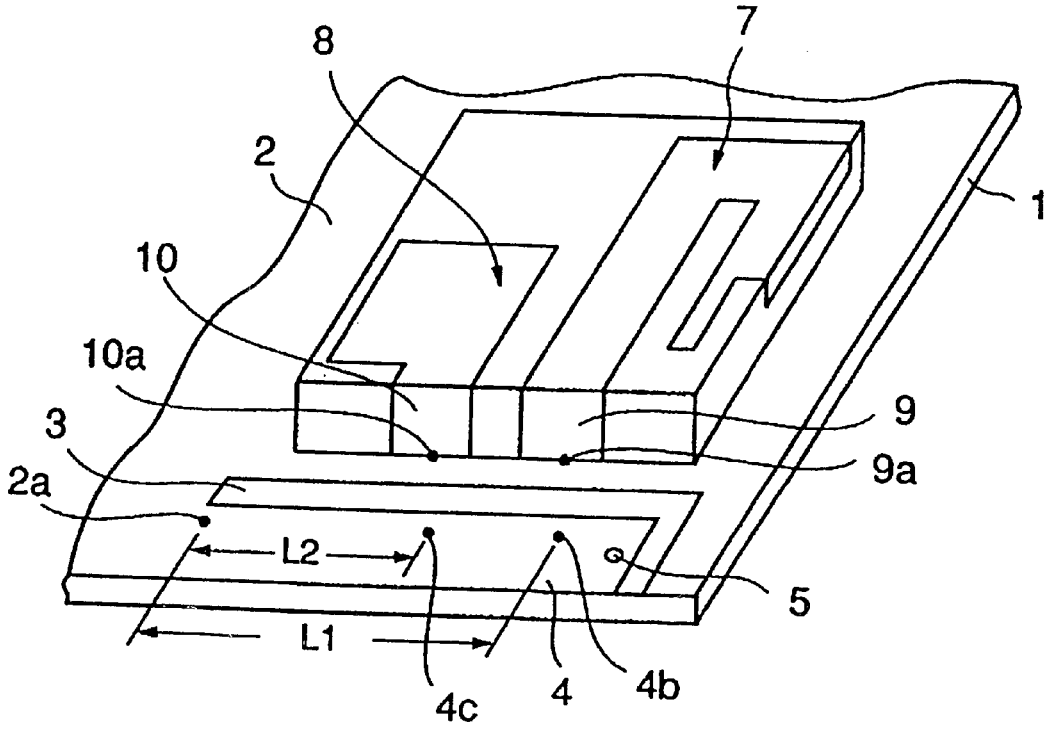
FIG. 2 is an exploded perspective view of the antenna apparatus shown in FIG. 1.

More specifically, as shown in FIG. 2, since the electrical length of the first feeding-radiating element 7 is different from the electrical length of the second feeding-radiating element 8, the impedance matching to the feeding point 5, namely, the signal source, is separately performed for the first feeding-radiating element 7 and the second feeding-radiating element 8. In the following description, for simplification of illustration, the widths of the first and second feeding electrodes 9 and 10 are represented by feeding nodes 9*a* and 10*a,* respectively.

The reactance of the short stub 4 is given based on the stub length. Specifically, since the short stub 4 is separated from the ground conductive layer 2 by the slit 3, the reactance for the first feeding-radiating element 7 is given based on length (stub length) L1 from a ground point 2*a* at the leading end portion of the slit 3 to a first matching point 4*b*. Likewise, the reactance for the second feeding-radiating element 8 is given based on stub length L2 from the ground point 2*a* to a second matching point 4*c*.

The feeding node 9*a* of the first feeding-radiating element 7 is connected to the first matching point 4*b* of the short stub 4, and the reactance given based on the stub length L1 is applied to the first feeding-radiating element 7. This provides the optimum impedance matching between the first feeding-radiating element 7 and the feeding point 5, resulting in a satisfactory resonance property at the first feeding-radiating element 7.

The feeding node 10*a* of the second feeding-radiating element 8 is connected to the second matching point 4*c* of the short stub 4, and the reactance given based on the stub length L2 is applied to the second feeding-radiating element 8. Since the second feeding-radiating element 8 is excited at a higher frequency than that of the feeding-radiating element 7, the second feeding-radiating element 8 requires lower reactance for the optimum impedance matching to the feeding point 5 than that of the first feeding-radiating element 7. Thus, the stub length L2 is shorter than the stub length L1, i.e., L1>L2.

Accordingly, the first and second feeding electrodes 9 and 10 of the first and second feeding-radiating elements 7 and 8 are coupled to the optimum matching points 4*b* and 4*c* of the short stub 4, respectively, thereby providing a satisfactory resonance property for each of the first feeding-radiating element 7 and the second feeding-radiating element 8. The optimum impedance matching allows the maximum power to be supplied to the first and second feeding-radiating elements 7 and 8, so that the gain of the first and second feeding-radiating elements 7 and 8 is high.

The stub length optimization for each of the first and second feeding-radiating elements 7 and 8 allows sufficient radiating resistance to be maintained for resonance in each of the first and second feeding-radiating elements 7 and 8. Therefore, a sufficient bandwidth can be maintained in the frequency bands for the individual resonance by the first feeding-radiating element 7 and the second feeding-radiating element 8.

An antenna apparatus according to a second preferred embodiment of the present invention is now described with reference to FIG. 3. The feature of the second preferred embodiment is that dual resonance is achieved by the addition of a parasitic radiating element. The same reference numerals are given to the same components as those in the first preferred embodiment shown in FIG. 1, and duplicative description thereof is omitted.

Figure 3:
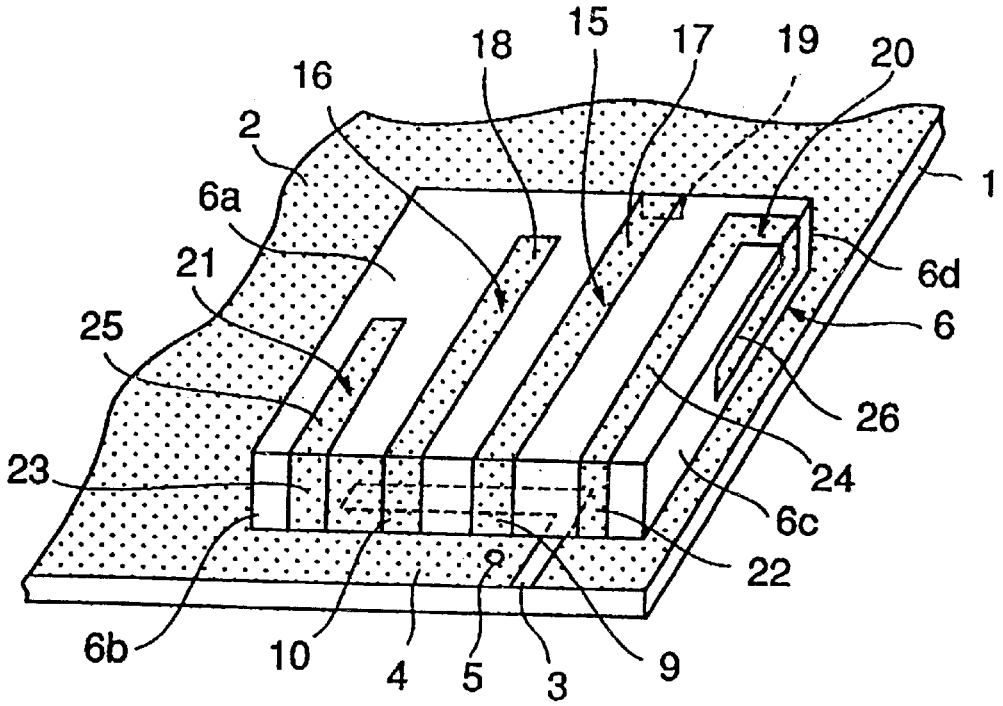
FIG. 3 is a perspective view of an antenna apparatus according to a second preferred embodiment of the present invention.

In FIG. 3, a first feeding-radiating element 15 and a second feeding-radiating element 16 are disposed on the principal surface 6*a* of the base 6. The first feeding-radiating element 15 includes a strip radiating electrode 17 extending from the top end of the feeding electrode 9 to the side surface 6*d*, and the strip radiating electrode 17 is then connected to a capacitive electrode 19. The second feeding-radiating element 16 includes a strip radiating electrode 18 extending from the top end of the feeding electrode 10 on the principal surface 6*a* substantially parallel to the radiating electrode 17. The second feeding-radiating element 16 is excited at a higher frequency than that of the first feeding-radiating element 15.

A first parasitic radiating element 20 is adjacent to the first feeding-radiating element 15. A ground electrode 22 of the first parasitic radiating element 20 is disposed on the side surface 6*b* on which the feeding electrodes 9 and 10 are provided, and the bottom end of the ground electrode 22 is connected to the ground conductive layer 2. The first parasitic radiating element 20 extends from the top end of the ground electrode 22 on the principal surface 6*a* in parallel to the radiating electrode 17. The first parasitic radiating element 20 is turned around toward the second side surface 6*c* before reaching the side surface 6*d*, and is then connected to a capacitive electrode 26 disposed on the second side surface 6*c*.

The first parasitic radiating element 20 is electromagnetically coupled with the first feeding-radiating element 15 to receive a supply of excitation power, and dual resonance is achieved at the same frequency band.

Like the first parasitic radiating element 20, a second parasitic radiating element 21 includes a ground electrode 23 and a radiating electrode 25 disposed on the surfaces of the base 6, and is adjacent to the second feeding-radiating element 16. The radiating electrode 25 of the second parasitic radiating element 21 is electromagnetically coupled with the second feeding-radiating element 16 to achieve dual resonance at the same frequency with the second feeding-radiating element 16 having an electrical length adjusted according to the reactance of the stub 4, resulting in a broader bandwidth.

An antenna apparatus according to a third preferred embodiment of the present invention is now described with reference of FIG. 4. The feature of the third preferred embodiment is that an open stub is provided. The same reference numerals are assigned to the same elements as those in the first preferred embodiment shown in FIG. 1, and a duplicative description thereof is omitted.

Figure 4:
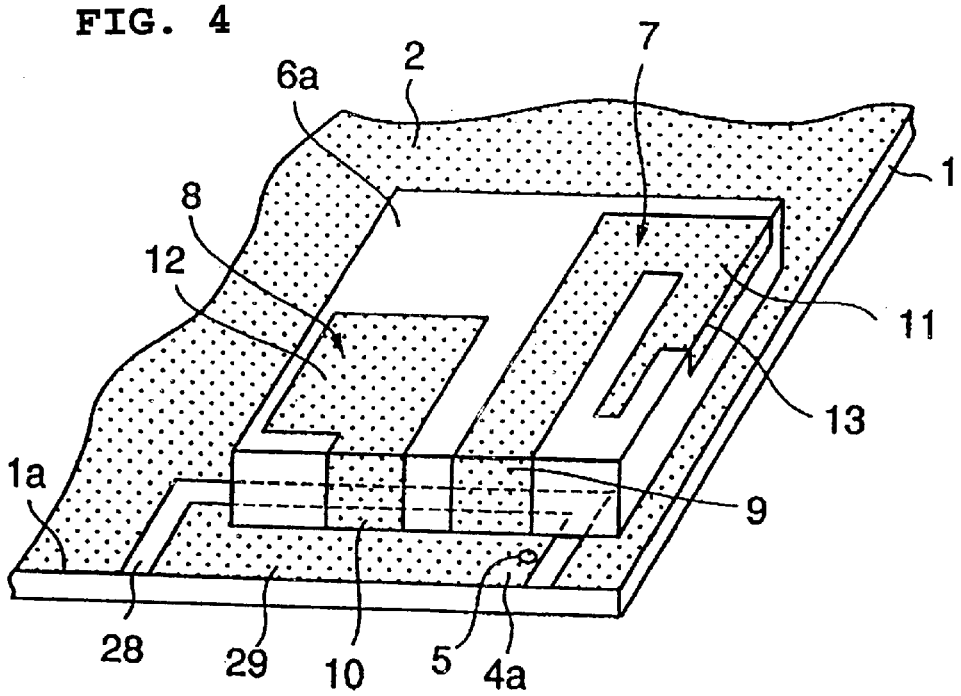
FIG. 4 is a perspective view of an antenna apparatus according to a third preferred embodiment of the present invention.

In FIG. 4, a portion of the ground conductive layer 2 of the substrate 1 is separated by a slit 28, where an open stub 29 is provided. The slit 28 is formed in the ground conductive layer 2 to form a substantially U-shaped bar extending from the substrate edge 1*a*. The separated portion of the ground conductive layer 2 defines the substantially rectangular stub 29 extending along the substrate edge 1*a*.

The feeding point 5 is positioned at the end of the stub 29 near the first feeding-radiating element 7. The effective stub length from the feeding point 5 to the feeding electrode 10 of the second feeding-radiating element 8 is longer than the effective stub length from the feeding point 5 to the feeding electrode 9. This allows reactance that is different from that of the first feeding-radiating element 7 to be applied to the second feeding-radiating element 8. Therefore, the impedance matching to the feeding point 5 or the signal source is separately performed for the first and second feeding-radiating elements 7 and 8. It is noted that the feeding point 5 may be placed at a different position to achieve impedance matching to the first feeding-radiating element 7 and the second feeding-radiating element 8.

Figure 5:
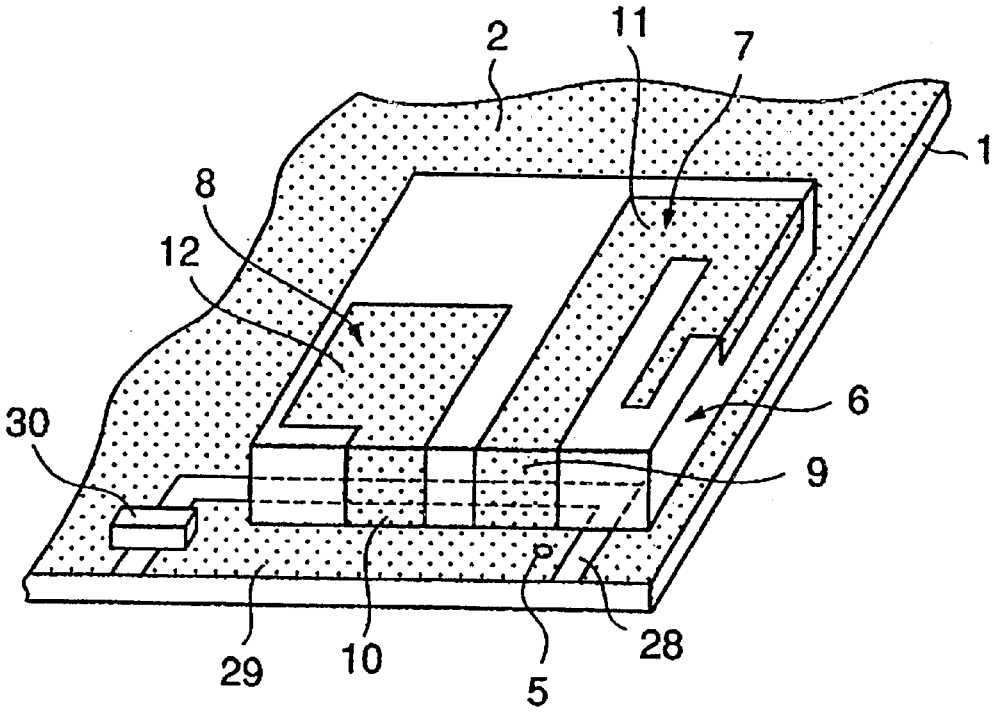
FIG. 5 is a perspective view of an antenna apparatus according to the third preferred embodiment of the present invention.

As shown in FIG. 5, the open stub 29 in the third preferred embodiment shown in FIG. 4 may be changed to a short stub by connecting a reactor 30 over the slit 28 between the open stub 29 and the ground conductive layer 2. The reactor 30 may be implemented as an inductor such as a chip inductor, or a capacitor such as a chip capacitor may be used depending upon the matching condition.

With this structure, the effective stub lengths from the ground potential to the feeding electrodes 9 and 10 of the first and second feeding-radiating elements 7 and 8 may be changed by selecting the reactance of the reactor 30. That is, the effective stub length from the ground potential of the ground conductive layer 2 to the feeding electrode 9 is determined based on the reactance of the reactor 30 to achieve impedance matching between the first feeding-radiating element 7 and the feeding point 5 or the signal source. Likewise, the effective stub length from the ground potential to the feeding electrode 10 is determined based on the reactance of the reactor 30 to achieve impedance matching between the second feeding-radiating element 8 and the feeding point 5.

Figure 6:
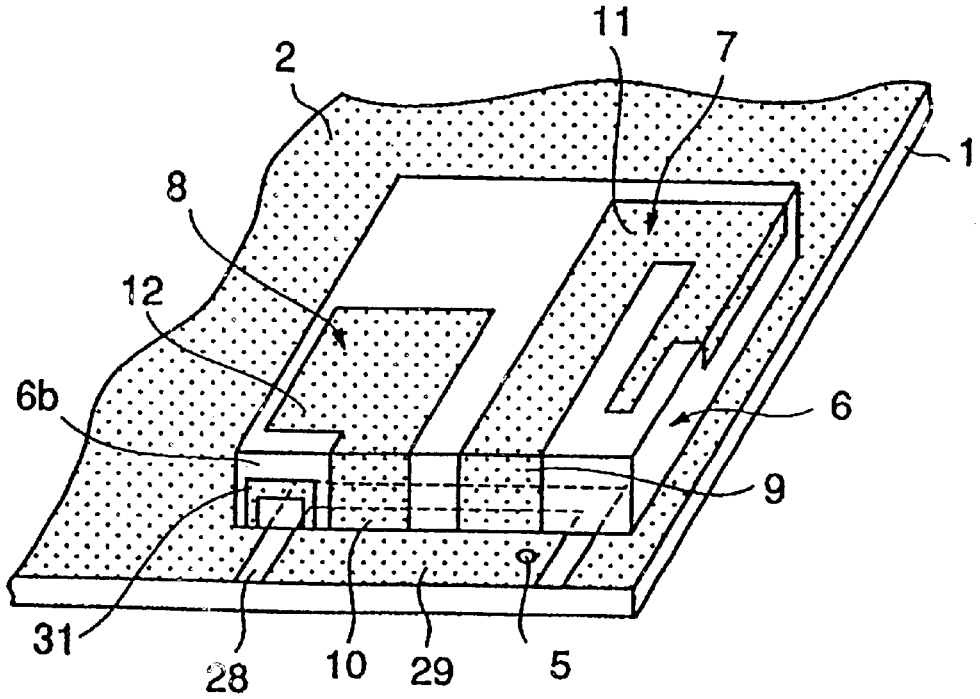
FIG. 6 is a perspective view of an antenna apparatus according to the third preferred embodiment of the present invention.

As shown in FIG. 6, the reactor 30 which bridges between the open stub 29 and the ground conductive layer 2 may be constructed by a reactance pattern 31 disposed on the first side surface 6*b* of the base 6, rather than a lumped element. The reactance pattern 31 is a meandering pattern electrode having an inductance component. One end of the reactance pattern 31 is connected to the ground conductive layer 2, and the other end of the reactance pattern 31 is connected to the open stub 29. The inductance of the reactance pattern 31 may be adjusted by trimming the reactance pattern 31.

An antenna apparatus according to a fourth preferred embodiment of the present invention is now described with reference to FIG. 7. The feature of the fourth preferred embodiment is that a stub pattern is disposed on a side surface of a base. The same reference numerals are assigned to the same elements as those in the first preferred embodiment shown in FIG. 1, and a duplicative description thereof is omitted.

Figure 7:
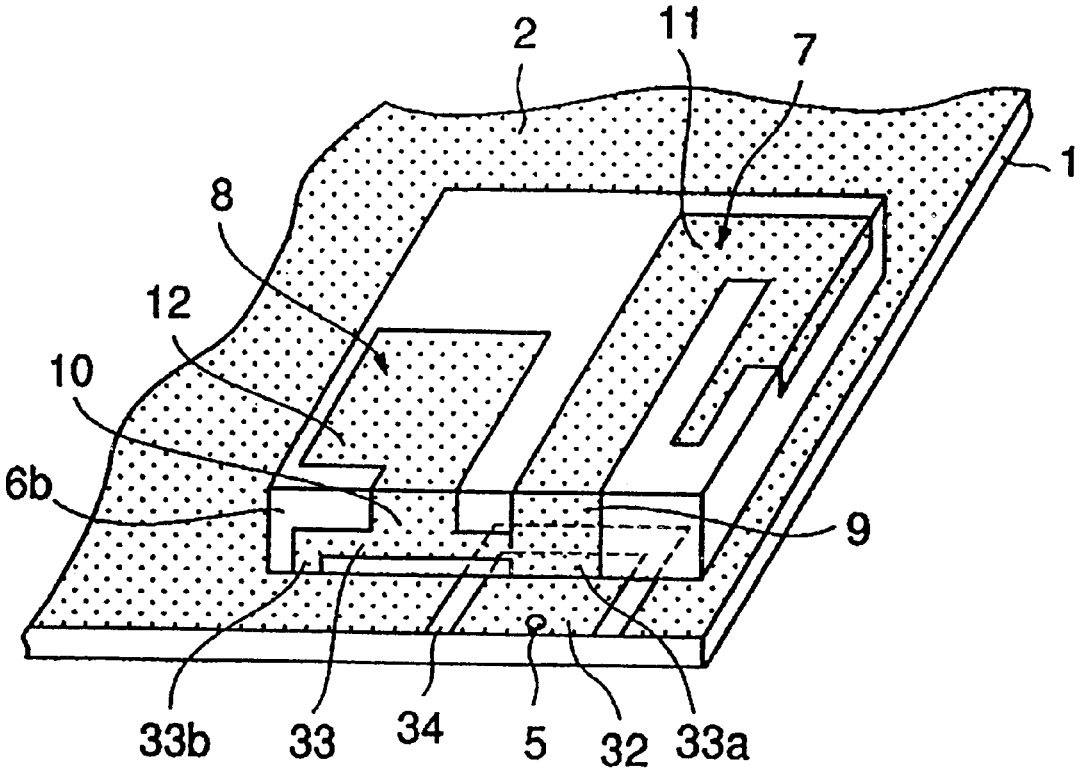
FIG. 7 is a perspective view of an antenna apparatus according to a fourth preferred embodiment of the present invention.

In FIG. 7, the feeding point 5 is positioned on a feeding land 32 which is separated from the ground conductive layer 2 by a slit 34. A stub pattern 33 is disposed on the first side surface 6*b* of the base 6 so as to be aligned with the feeding electrodes 9 and 10 and to bridge over the slit 34. A feeding end 33*a* of the stub pattern 33 is connected to the feeding land 32, and is formed by extending the feeding electrode 9 of the feeding-radiating element 7 to the bottom end of the base 6. A ground end 33*b* of the stub pattern 33 is connected to the ground conductive layer 2 of the substrate 1. This enables the stub pattern 33 and the feeding land 34 to function as a short stub.

In the stub pattern 33, the feeding electrodes 9 and 10 of the feeding-radiating elements 7 and 8 are integrally arranged, and the node therebetween is set at the optimum matching point which is determined according to the stub length originating from the ground end 33*b* of the stub pattern 33. The effective stub length can be changed by changing the length and width of the stub pattern 33. The effective stub length can also be changed by changing the position at which the feeding end 33*a* of the stub pattern 33 is connected to the feeding land 32, namely, a distance from the feeding point 5 to the feeding end 33*a*.

As described above, in an antenna apparatus according to preferred embodiments of the present invention, a feeding electrode of each of a plurality of feeding-radiating elements is connected to a matching point of a stub with a feeding point, thereby achieving the optimum matching at a frequency allocated to each of the feeding-radiating elements. Thus, the antenna apparatus achieves a very high gain and a sufficient frequency bandwidth.

Furthermore, a parasitic element is adjacent to at least one feeding-radiating element to achieve dual resonance, and the frequency bandwidth to which the resonance frequency for the dual resonance belongs can thus be broader than the frequency bandwidth for the resonance by the feeding-radiating element alone.

The stub may be a short stub of which a portion far from the feeding point is coupled to the ground, and the optimum matching for each feeding-radiating element can thus be achieved using the stub length from the ground potential.

The stub may be an open stub which is separated from a ground conductive layer provided on the substrate by a slit formed in the ground conductive layer, and the stub can thus be readily formed. The matching points required for the respective feeding-radiating elements can also be determined.

Furthermore, a reactor may be connected between the open stub and the ground conductive layer, thereby achieving the desired impedance matching between each of the feeding-radiating elements and the feeding point by selecting the reactance of that lumped element.

Furthermore, a reactance pattern may be located on a surface of a base having feeding-radiating elements disposed thereon, thereby achieving impedance matching between each of the feeding-radiating elements and the feeding point based on the reactance without use of a lumped element.

Furthermore, a stub may include a feeding land provided on the substrate, and a stub pattern disposed on the base, thereby achieving simultaneous formation of the stub pattern and feeding electrodes in consideration of a difference between the matching to one feeding-radiating element and the matching to another feeding-radiating element.

While the present invention has been described with reference to what are at present considered to be preferred embodiments, it is to be understood that various changes and modifications may be made thereto without departing from the invention in its broader aspects and therefore, it is intended that the appended claims cover all such changes and modifications that fall within the true spirit and scope of the invention.

What is claimed is:

1. An antenna apparatus comprising:

a base;

a plurality of feeding-radiating elements each including a feeding electrode and a radiating electrode which are disposed on the base; and a substrate arranged to support the base;

wherein a common feeding point for feeding a current to the plurality of feeding-radiating elements is located on the substrate;

a stub continuously expanding from the common feeding point is disposed on a surface of the substrate, or on a surface of the base and a surface of the substrate; and the feeding electrodes of the plurality of feeding-radiating elements are connected to matching points of the stub which are determined based on the effective line length of the radiating electrodes.

2. An antenna apparatus according to claim 1, wherein a radiating electrode without a feeding electrode is disposed on a surface of the base so as to be adjacent to the radiating electrode of at least one of the plurality of feeding-radiating elements.

3. An antenna apparatus according to claim 1, wherein the stub is a short stub of which a portion far from the feeding point is coupled to a ground.

4. An antenna apparatus according to claim 1, further comprising a ground conductive layer disposed on the substrate, wherein the stub is an open stub which is separated from the ground conductive layer by a slit formed in the ground conductive layer.

5. An antenna apparatus according to claim 4, wherein a reactor is connected between the stub and the ground conductive layer.

6. An antenna apparatus according to claim 5, wherein the reactor includes a pattern electrode having a reactance component which is disposed on the base.

7. An antenna apparatus according to claim 5, wherein the reactor includes one of a reactance pattern and a lumped element.

8. An antenna apparatus according to claim 5, wherein the reactor is arranged to achieve impedance matching between each of the feeding-radiating elements and the common feeding point.

9. An antenna apparatus according to claim 4, wherein the slit extends in a direction that is substantially perpendicular to an edge of the substrate and is bent at a right angle and extending substantially parallel to the substrate edge.

10. An antenna apparatus according to claim 4, wherein the open stub defines a substantially U-shaped bar extending from the substrate edge.

11. An antenna apparatus according to claim 1, wherein the stub includes a feeding land having a feeding point which is disposed on the substrate, and a stub pattern which is disposed on the base and which is connected to the feeding land.

12. An antenna apparatus according to claim 1, wherein the base is made of a dielectric material.

13. An antenna apparatus according to claim 1, wherein the substrate is made of an epoxy resin containing a glass fiber.

14. An antenna apparatus according to claim 1, further comprising a ground conductive layer disposed on the substrate.

15. An antenna apparatus according to claim 1, wherein the plurality of feeding-radiating elements include first and second feeding-radiating elements, and the second feeding-radiating element has an electrical length for excitation at a higher frequency than that of the first feeding-radiating element.

16. An antenna apparatus according to claim 1, wherein a signal power is supplied from the common feeding point positioned on the substrate to the feeding electrodes according to different reactance of the stub.

17. An antenna apparatus according to claim 1, wherein the plurality of feeding-radiating elements include first and second feeding-radiating elements, and the second feeding-radiating element has a higher excitation frequency than that of the first feeding-radiating element.

18. An antenna apparatus according to claim 1, further comprising at least one parasitic radiating element arranged on the base and electromagnetically coupled with one of the feeding-radiating elements to achieve dual resonance with the one of the feeding-radiating elements.

19. An antenna apparatus according to claim 1, further comprising a plurality of parasitic radiating elements arranged on the base and electromagnetically coupled with respective ones of the feeding-radiating elements to achieve dual resonance with the respective ones of the feeding-radiating elements.

20. An antenna apparatus according to claim 1, wherein the stub includes a stub pattern disposed on a side surface of the base.

* * * * *